US005416564A

United States Patent [19]

Thompson et al.

[11] Patent Number: 5,416,564

[45] Date of Patent: May 16, 1995

[54] XEROGRAPHIC PROCESS CONTROL USING DEVELOPER TO PHOTORECEPTOR CURRENT SENSING FOR GRID VOLTAGE ADJUST

[75] Inventors: David M. Thompson, Fairport; Carol J. Panepinto, Rochester; Edward C. Savage, Webster, all of N.Y.

[73] Assignee: Xerox Corporatin, Stamford, Conn.

[21] Appl. No.: 192,326

[22] Filed: Feb. 4, 1994

[51] Int. Cl.[6] ..... G03G 21/00

[52] U.S. Cl. ..... 355/208; 250/325; 355/221; 355/225

[58] Field of Search ..... 355/203, 204, 208, 219, 355/221, 225, 246; 361/225, 230; 250/324–326

[56] References Cited

U.S. PATENT DOCUMENTS

| | | | |
|---|---|---|---|
| 4,348,099 | 9/1982 | Fantozzi | 355/208 |
| 5,099,279 | 3/1992 | Shimizu | 355/208 |
| 5,150,135 | 9/1992 | Casey et al. | 355/208 X |
| 5,321,468 | 6/1994 | Nakane et al. | 355/208 |

*Primary Examiner*—A. T. Grimley
*Assistant Examiner*—William J. Royer
*Attorney, Agent, or Firm*—Ronald F. Chapuran

[57] ABSTRACT

An image processing apparatus having a corona device for charging a photoreceptor to voltage levels, a developer for applying toner to the photoreceptor including a sensor for providing signals in relation to current flow between the photoreceptor and the developer as a result of the developer applying toner to the photoreceptor on predetermined patches, and a corona control responsive to the signals for adjusting the corona device for charging the photoreceptor to adjusted voltage levels.

14 Claims, 8 Drawing Sheets

XEROGRAPHIC PROCESS CONTROL USING DEVELOPER TO PHOTORECEPTOR CURRENT SENSING FOR GRID VOLTAGE ADJUST

BACKGROUND OF THE INVENTION

The invention relates to xerographic process control, and more particularly, to improved xerographic process control using developer to photoreceptor current sensing for adjusting the grid voltage of a charging device.

Xerographic control is well known in the prior art. The art is replete with various sensors and systems for charging control, for exposure and illumination control, for developer control, and for measuring toner concentration and adjusting toner dispensers. For example, U.S. Pat. No. 4,348,099 discloses the uses of test patches, an infrared densitometer, and an electrometer for charge, illumination, toner dispenser, and developer bias control.

One difficulty with prior art systems has often been the need for costly sensors such as infrared densitometers and electrometers. Another difficulty has been the inability to account for significant electrostatic differences between photoreceptor surfaces on different machines and even to account for significant electrostatic differences between different segments of the same photoreceptor surface on a given machine. It would be desirable, therefore, to provide reliable and less costly photoreceptor voltage control to produce higher quality copies over the life of the photoreceptor.

It is an object, therefore, of the present invention to provide new and improved photoreceptor voltage control by sensing developer to photoreceptor current as toner patches are developed and using the sensed current to adjust the grid voltage of a charging scorotron. Other objects and advantages of the present invention will become apparent as the following description proceeds, and the features characterizing the invention will be pointed out with particularity in the claims annexed to and forming a part of this specification.

SUMMARY OF THE INVENTION

An image processing apparatus having a scorotron device for charging a photoreceptor to voltage levels, a developer for applying toner to the photoreceptor including a sensor for providing signals in relation to current flow between the photoreceptor and the developer as a result of the developer applying toner to the photoreceptor in predetermined regions called patches, and a scorotron control responsive to the signals for adjusting the corona device for charging the photoreceptor to adjusted voltage levels.

For a better understanding of the present invention, reference may be had to the accompanying drawings wherein the same reference numerals have been applied to like parts and wherein:

DETAILED DESCRIPTION OF THE DRAWINGS

DETAILED DESCRIPTION OF THE PREFERRED EMBODIMENT

Figure 1:
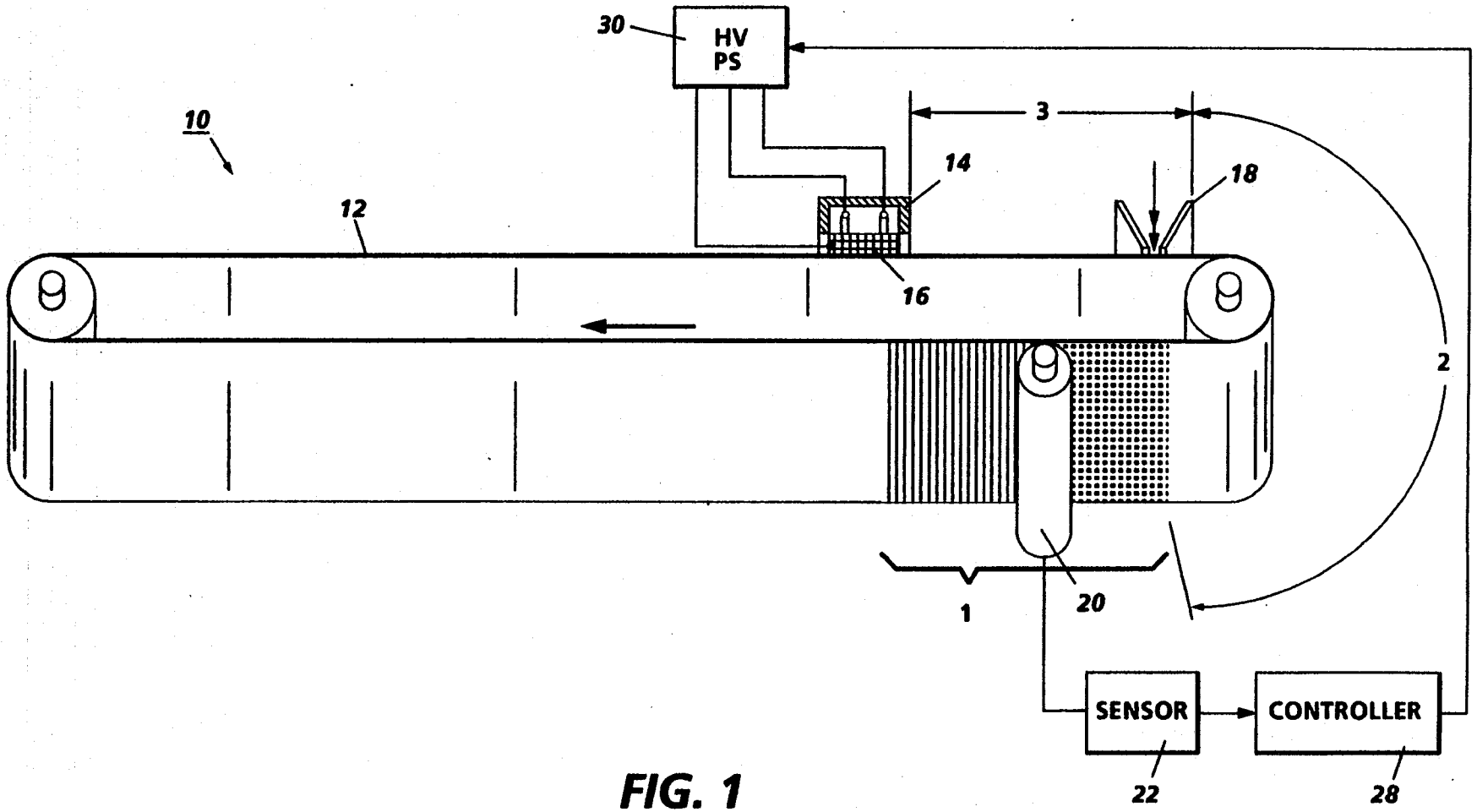
FIG. 1 is an elevational view depicting portions of a typical electrostatic system incorporating the present invention.

Referring to FIG. 1, there is generally shown at 10 portions of an exemplary printing or reproduction machine in which the features of the present invention may be incorporated. It should be understood that FIG. 1 could be any suitable machine having various well known machine components including a photoconductive surface 12 rotated through various stations. For example, a charging station employs a corona generating device such as a scorotron 14 having a charging electrode and grid 16 positioned adjacent the photoconductive surface 12 to charge the photoconductive surface to a relatively high uniform potential.

The charged portion of photoconductive surface 12 is then rotated to an exposure station 18 for producing a light image of an original document placed on a not shown platen. In particular, a lamp illuminates incremental portions of the original document disposed on the platen in moving across the platen. The light rays reflected from the original document are projected onto the photoconductive surface.

As the surface 12 continues to rotate, the recorded electrostatic latent image is advanced to a development station including a not shown housing containing a supply of developer mix and a developer roller 20. The developer roller 20 is typically a magnetic (mag) brush roller and generally includes a stationary magnetic member having a non-magnetic, rotatable tubular member interfit telescopically over the stationary member. The developer roller 20 advances the developer mix into contact with the electrostatic latent image on the photoconductive surface. As successive electrostatic latent images are developed, the toner particles within the developer mix are depleted. Additional toner particles are stored in a suitable toner cartridge and dispensed as needed.

Other not shown but well known xerographic steps complete the process. For example, after the toner powder image has been developed on a photoconductive surface, often a corona generating device applies a charge to pre-condition the toner powder image for transfer. A sheet of support material is advanced by suitable sheet feeding apparatus to a transfer station including a corona generating device for charging the underside of the sheet of support material to a level sufficient to attract the toner powder image from a photoconductive surface.

After transfer of the toner powder image to the sheet of support material, a suitable stripping system separates the sheet from the photoconductive surface and advances it to a not shown fusing station. The fusing station includes a heated fuser roll in contact with a resilient backup roll. The sheet of support material advances between the fuser roll and the backup roll with the toner powder image contacting the fuser roll. After the toner powder image has been permanently fused to the copy sheet, the copy sheets are advanced by a series of rollers to suitable output trays.

To set the photoreceptor DDP or dark development potential to the right starting level at power-up or at predetermined copy intervals would typically require a sensor such as an ESV (Electro-Static Voltmeter) to measure the photoreceptor voltage directly or an IRD (Infrared Densitometer) to measure toner development and then adjust the Scorotron Grid to obtain the required DDP. These sensors add prohibitive cost to the product.

In accordance with the present invention, there is provided a low cost method of using CSDC (current sensing developability control) circuitry to measure photoreceptor or photoconductive surface potential and adjust the scorotron grid to obtain the desired DDP without the use of the more costly ES and IRD sensors.

In general, according to one feature of the present invention, current flow between the developer housing and the photoreceptor is used to determined the amount of voltage on the photoreceptor. CSDC technology provides signals from the current flow induced by toner leaving the developer housing during copy image or toner patch development. In other words, as toner leaves the developer mag brush or magnetic roll and is attracted to the photoreceptor, there is a measurable current flow. The more charge on the photoreceptor, the more toner that leaves the magnetic roll. By development of selected toner patches, the amount of voltage on the photoreceptor can be determined.

In particular, CSDC circuitry relies on the functional relationship between toner tribo charge level Q (coulombs/gram) and the rate of toner transfer to the photoreceptor M (grams/second) that is, $^{I}$BIAS (coulombs/-second)=Q×M. This relationship is linear and the slope is established by the system geometry. The current, $^{I}$BIAS, is substantially independent of toner concentration and developer housing sump tribo. The current is a function of the percent area coverage and surface potential of the latent image on the photoreceptor. By fixing area coverage at 100 percent, $^{I}$BIAS now only depends on the potential of the latent image on the photoreceptor.

The latent image potential establishes the toner development field. The development field is functionally related to the latent image potential minus the developer housing bias voltage. ($^{V}$DEV=$^{V}$P/R−$^{V}$BIAS). Toner development area coverage is fixed and $^{V}$BIAS is fixed. This makes $^{V}$DEV proportional to photoreceptor latent image $^{V}$P/R. Therefore, as $^{V}$P/R is increased above $^{V}$BIAS, BIAS current $^{I}$BIAS increases in proportion. $^{I}$BIAS is measured as the response to determine the voltage $^{V}$P/R. This knowledge is applied as follows: By measuring $^{I}$BIAS (developer bias current during toner development), $^{V}$DEV can be determined from the $^{V}$DEV$^{I}$BIAS relationship.

Figure 2:
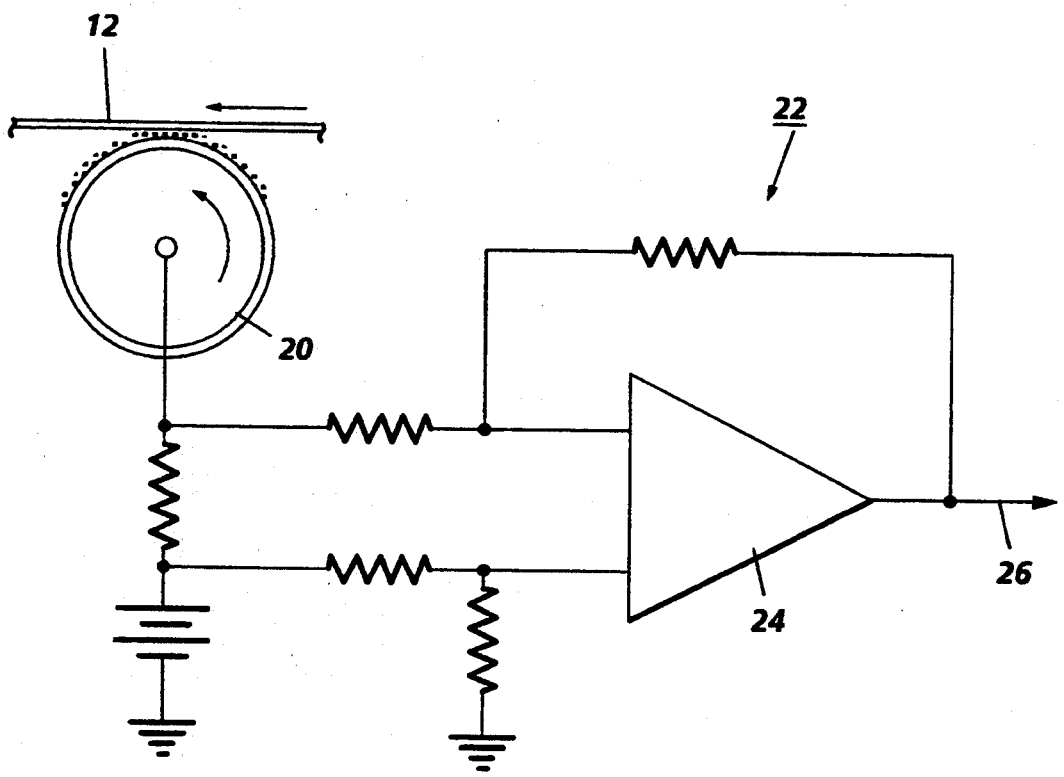
FIG. 2 is a circuit diagram in accordance with the present invention depicting a typical current sensor shown in FIG. 1.

With reference to FIG. 2, there is generally disclosed a typical current sensing device 22 in relation to photoconductive surface 12 showing a negative charge disposed opposite a developer mag brush supporting positively charged toner particles. Current sensing devices are known in the prior art. One embodiment includes Op Amp 24 with suitable resistive elements providing an output signal at 26. The induced current flow from the charge transfer from the positive charged toner particles to the negatively charged photoconductive surface is measured by any suitable circuit. Current flow can be measured directly or a proportional voltage level can be measured at the output of the amplifier. It should be understood that any suitable current measuring circuitry can be used and that it is only important to have a measurement that is related to the current flow of the toner particles to the photoconductive surface that, in turn, can be used to adjust the charge on the photoconductive surface.

Figure 3:
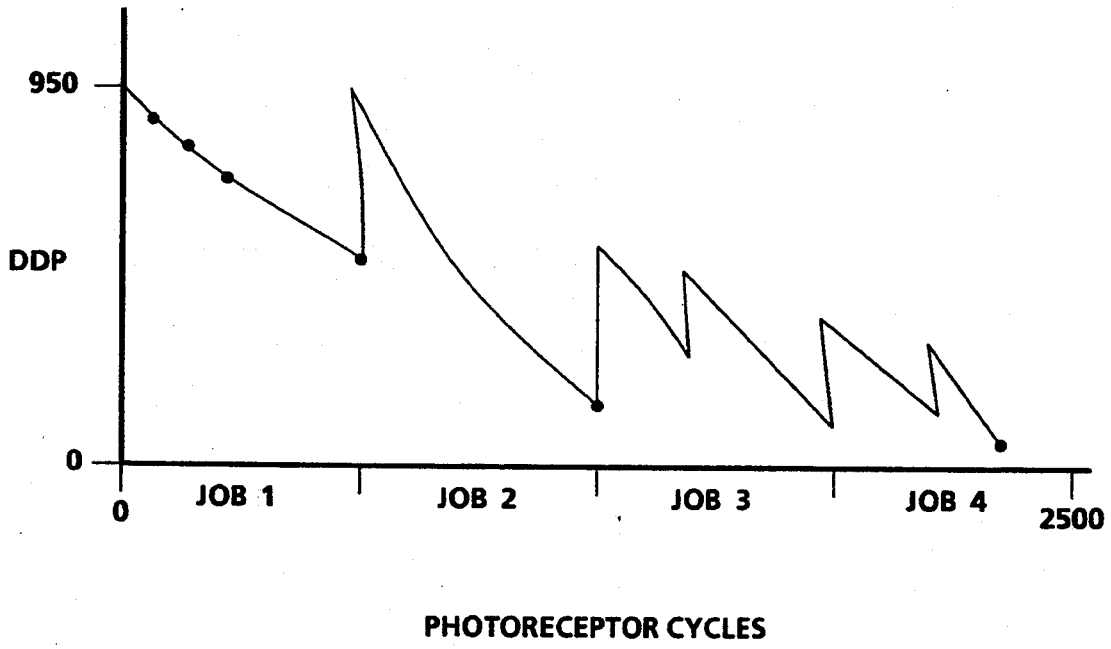
FIG. 3 illustrates typical photoreceptor electrostatic behavior during copy runs at a constant charging voltage.

The present invention is generally a remedy to correct and compensate for two conditions present in prior art systems. One is the tendency of a photoreceptor material to degrade and wear over time with the resultant loss of consistency and uniform charge retention ability. This is illustrated in FIG. 3 showing in exaggerated form typical photoreceptor charge retaining properties or dark development potential along the vertical axis as a function of photoreceptor cycles or usage along the horizontal axis. The spike portions of the curve illustrate the ability of the photoreceptor material to recover the charge retention capability after periods of rest after gradual decreases in the charge retention capability during a job run. However, even with rest recovery, the aging tendency is for the photoreceptor to gradually drop from a high DDP to an unacceptable DDP after repeated usage, shown as 2500 cycles. One feature of the present invention is to make adjustments to maintain a much more linear or horizontal DDP with time and to compensate for photoreceptor aging and rest recovery.

The second condition in the prior art is the tendency of different segments of the same photoreceptor surface to exhibit different charge retention ability. In particular, discrete areas of the belt are subject to unique environments such as heat from the fuser, trapped ozone, and nitrous oxides which alter the performance of the belt at different rates in different locations. For example, the segment of the photoreceptor normally opposite the fuser station during periodic at rest periods will be affected by heat from the fuser and show a much different voltage retention behavior than other segments of the photoreceptor.

Figure 4:
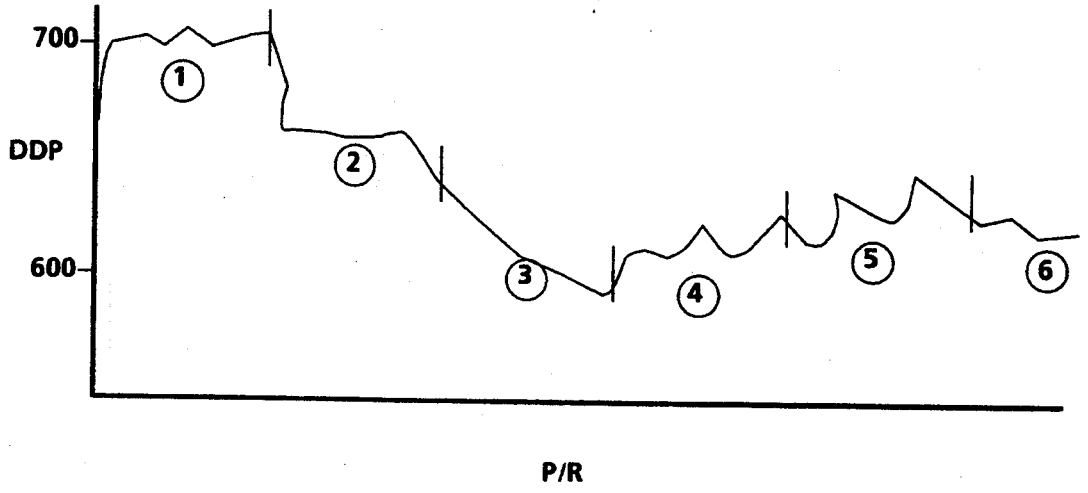
FIG. 4 illustrates a typical voltage profile by segments of an aging photoreceptor.

This is illustrated in FIG. 4 showing the dark development potential of 6 segments of a photoconductive surface. It should be noted that the photoconductive surface could be divided into any arbitrary number of segments for analysis or corrective adjustment. As illustrated, segment 1 with the relatively high potential would typically be the segment normally adjacent the fuser during at rest periods. In general, a toner patch developed on one area of an aged photoconductive surface will differ from other developed patches and will not necessarily predict with accuracy a level of charge needed for the next patch which is in a different location on the photoreceptor belt.

According to another feature of the present invention, the charging device for the photoconductive surface is a scorotron. The sensed current flow providing a measure of the charge on the photoconductive surface is used to adjust the grid voltage of the scorotron to change the voltage level on the photoconductive surface. As shown in FIG. 1, sensor 22 provides a signal to controller 28 connected to high voltage power supply 30. The high voltage power supply 30, in turn, adjusts the voltage on scorotron grid 16 to change the charging voltage on photoconductive surface 12.

Figure 5A:
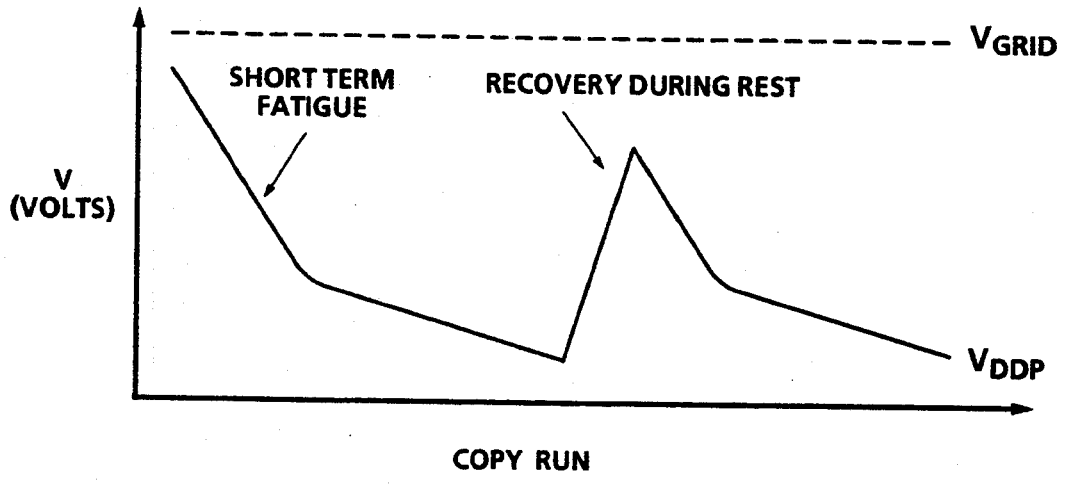
FIG. 5A PRIOR ART
FIGS. 5A and 5B illustrate compensation for typical photoreceptor electrostatic behavior by adjusting charging voltage in accordance with the present invention.

Another feature of the present invention is a general technique to electrostatically set up the photoconductive surface to proper levels of photoconductive surface charge and to maintain more uniform photoconductive surface voltage characteristics and copy quality during job run using current sensing developability control technology. This is done primarily by suitable adjustment of scorotron grid voltage. With reference to FIGS. 5A, there is shown a typical prior art behavior of DDP or dark development potential over time with respect to fatigue and rest recovery of a photoconductive surface with the scorotron grid voltage held constant. As illustrated, short term fatigue and recovery during rest periods significantly affect the level of DDP.

Figure 5B:
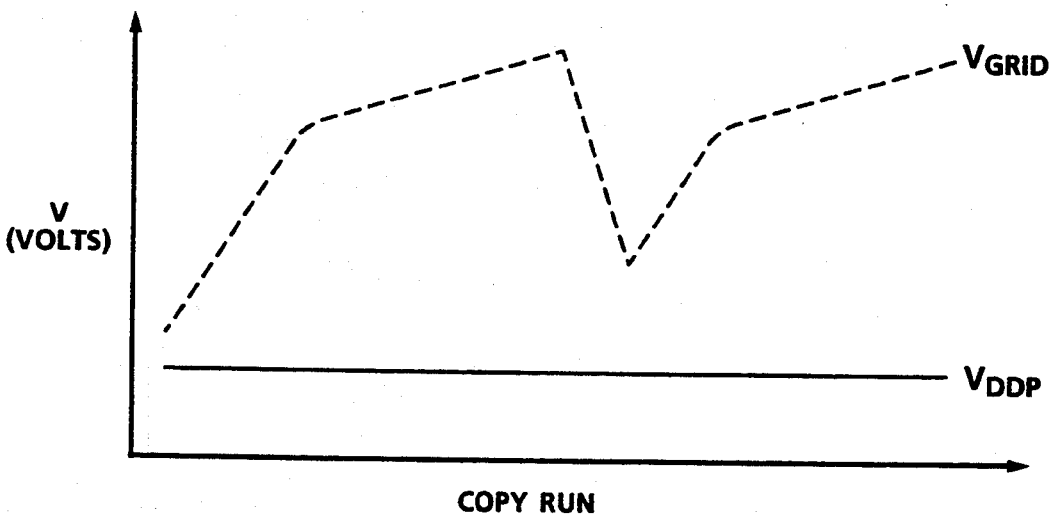

In accordance with the present invention, with respect to FIG. 5B, the grid voltage is adjusted to compensate for photoconductive surface fatigue and rest recovery in order to maintain DDP relatively constant. Thus, as the photoconductive surface fatigues, a corrective factor is applied to the grid voltage through the high voltage power supply to level off the DDP voltage. In a similar fashion, for periods of rest recovery, a corrective factor is applied to the grid voltage through the high voltage power supply to again level off the DDP voltage. It should be noted that the adjustments can be tailored to specific segments of the photoconductive surface as well. It should also be noted that adjustments can be done during periodic set up periods or on the fly during job runs as will be further described below. The electrostatic set up can be automatically initiated periodically, for example, after 2500 cycles of the photoreceptor surface. In addition, the set up can be initiated manually by a service rep at given intervals or upon demand or upon predetermined machine conditions.

In another feature of the present invention, there is a multi cycle procedure or set of revolutions of the photoconductive surface to accomplish an electrostatic set up (ESU) as shown in the Table below. This set up compensates for the deterioration of a photoreceptor over time and even accounts for discrete photoreceptor segments. Initially, there are five charge/erase cycles to stabilize or condition the photoreceptor before initially setting the scorotron grid voltage.

| Cycle # | Action | Basic Explanation |
|---|---|---|
| 1 | Charge and erase cycle | CSDC zero point is measured to insure the setup can continue. Four charge and erase cycles to move the photoreceptor off the steep portion of the cycle down curve. |
| 2 | Charge and erase cycle | CSDC zero point is measured to insure the setup can continue. Four charge and erase cycles to move the photoreceptor off the steep portion of the cycle down curve. |
| 3 | Charge and erase cycle | CSDC zero point is measured to insure the setup can continue. Four charge and erase cycles to move the photoreceptor off the steep portion of the cycle down curve. |
| 4 | Charge and erase cycle | CSDC zero point is measured to insure the setup can continue. Four charge and erase cycles to move the photoreceptor off the steep portion of the cycle down curve. |
| 5 | Charge and erase cycle | CSDC zero point measured. |
| 6 | Set scorotron grid voltage | The grid voltage is set at a starting value and a ballpark calculation of grid voltage for DDP is done. |
| 7 | Set scorotron grid voltage | Algorithm hones in on the proper grid voltage (VgO) for a DDP of −785 volts. |
| 8 | Set scorotron grid voltage | Algorithm hones in on the proper grid voltage (VgO) for a DDP of −785 volts. |
| 9 | Charge on | Algorithm finishes DDP calculation. VgO is determined. |
| 10 | Charge and erase cycle | Cycle is used for mathematical calculations. |
| 11 | Grid set at VgO, erase set at 50% intensity. Bias voltage on | Set the exposure level using CSDC signal from 7 patches and illumination lamp set at 50% intensity. |
| 12 | | Set the exposure level using CSDC signal from 7 patches and illumination lamp set at 50% intensity. |
| 13 | | Set the exposure level using CSDC signal from 7 patches and illumination lamp set at 50% intensity. |
| 14 | | Set the exposure level using CSDC signal from 7 patches and illumination lamp set at 50% intensity. |
| 15 | Exposure set | Lamp intensity is doubled based on exposure multiplier and ABC sensor. |
| 16 | Charge and erase cycle | |
| 17 | Charge and erase cycle | |
| 18 | Charge cycle | Measurement of change in DDP and compared to cycle 9 measurement. Correction value calculated. |
| 19 | Charge, erase off; bias voltage on. | Rest recovery time. |
| 20 | Charge cycle | Measure short term rest recovery. |
| 21 | Transfer spiking | Helps eliminate line on copy. |

Cycle 1–4: In particular, during the first four cycles the photoreceptor is charged and discharged to fatigue the system to a point which is closer to normal operating voltage of the photoreceptor. This helps reduce the noise and reduces the slope of charge decay of the photoreceptor. For charging, the grid starts at −885 or the initial grid voltage (Vg0) used during the last 2500 cycles. Bias is set at −235 volts, pre-charge is on and Edge Erase is on. On the first cycle, the CSDC signal is checked to ensure that it is safe to continue running. Failure at this point will cause a given fault indication.

Cycle 5: Calculate CSDC Zero point. During this cycle, the low gain CSDC signal is measured. The CSDC Zero point is not a value of zero voltage but the current measured through the CSDC circuit when there is a normal charge and erase cycle with normal bias. Since CSDC signal changes in time and with numerous other variables, the signal is read once every electrostatic set up and every cycle of the photoreceptor during job runs and the zero point reset. Failure at this cycle will cause the display of a suitable fault code. Note that the zero point is constant throughout an ESU once the value is assigned on this cycle.

Cycle 6: Auto range. During cycle six, there is a rough adjustment of the grid voltage of the scorotron to establish a target CSDC signal. This is done with reference to one patch developing on the photoreceptor. The grid voltage starts at −885 volts with the developer bias set to −785 volts. The CSDC signal is measured and if it is in the range 0.8 to 1.2 uA the voltage on the grid is fixed. If the signal is not in that range bias voltage is lowered in steps of 50 volts until the CSDC current is greater than 0.8 microamps. If bias is lowered to −335 volts and the CSDC current is still below 0.8 microamps the grid is placed at a value of −1200 volts. Otherwise, add the amount the bias was dropped from −785 to −885 and put the total value on the grid for the start of set DDP. Precharge erase and Charge are on during this measurement, but edge erase and illumination lamps are off. Failure at this point will result in a fault code, indicating the failure to achieve the target CSDC value.

Cycle 7: Cycle seven is the start of the DDP measurement. Voltage on the grid is fixed at the autorange final value (cycle 6) and the CSDC signal is measured and compared to the actual value of the signal desired. Measurement takes place on six patches with the bias on the patches at 685 volts. The CSDC signal is stored in memory for each of the six patches generated.

Cycle 8: Converge on grid reading. This cycle is the same as cycle 7 except the grid values for each of the six patches comes from a calculation based on the grid voltage and CSDC readings for the corresponding patch of cycle 7. In otherwords, the grid voltage on each patch and the change in CSDC or delta CSDC for that patch are calculated as: Vgrid=Vgrid on cycle 7 patch "n" +delta CSDC multiplied by K (where K is a CSDC to voltage conversion factor).

Cycle 9: Cycle nine is the same as cycle 8 with Vgrid calculated as follows: Vgrid (patch n)=Vgrid (patch n) on cycle 8+((delta CSDC from target "n" and delta Vgrid between cycle 7–8)/delta CSDC between cycle 7–8) multiplied by K. At completion, grid becomes Vg0, bias is set to −235 volts. If a failure is detected, a suitable fault code would be given with the grid voltage defaulting to the last good setting or a NVM default.

Cycle 10: Dead cycling. The photoreceptor is dead cycled (charge and discharged) while the processor calculates the Vg0 value based on the voltages seen in cycle 9 (if cycle 9 was successful). Pre-charge erase, charge,and bias are all on during this cycle. However, the illumination lamp comes on late in the cycle to give the lamp time to get up to full intensity for the exposure routine.

Cycle 11–14: Set Exposure routine. During this phase, the exposure lamp voltage is adjusted to obtain a 330 volt potential. All four cycles try to hone in on the lamp voltage based on 50% exposure using the six patches available with at least 4 patches being good. Failure during the first two cycles will result in a given fault code. In the next two cycles, the lamp doubles based on an exposure multiplier. Failure in the last two cycles will result in another fault code. Either fault code will cause the setup to revert back to the previous exposure set point.

At the start of cycle 11, the lamp is set at the last exposure point for patches 1,2 and 3. The starting point for patch 4 comes from patch 1, 5 comes from 3, and 6 comes from 4. After this cycle, patch 1 predicts patch 1 and patch 2 predicts patch 2 etc . . . On cycle 12 thru 14, the patch lamp setting is based on the previous revolutions patch setting and the difference in the CSDC point from target.

Cycle 15: In cycle 15, the charge, erase lamp and bias are on. The control algorithm measures the exposure lamp intensity which results from the exposure set on cycle 14 using input from a photodiode, and makes the final background setting by adjusting the lamp output until the desired percentage change in the cycle 14 exposure is achieved (typically 200%).

Cycle 16–17: Charge and Discharge Cycles. During these cycles, the photoreceptor is charged and discharged Vgrid is constant and set at the value calculated in Cycle 9 (Vg0). Pre-charge, charge, exposure and bias are all on during these cycles.

Cycle 18: Auto-correct. This cycle measures the CSDC signal on 5 patches to find the change in photoreceptor potential since cycle 9, Vgrid is equal to Vg0 and bias is −685 volts. Using the change in potential, fatigue coefficients are calculated. The cycle down voltage is calculated for the run mode and a suitable counter is set.

Cycle 19: Rest Cycle. During this cycle there is no charge or discharge of the photoreceptor and no lights are on.

Cycle 20: Measure DDP and compare. This cycle is to measure the CSDC signal as in cycle 18 to find the change in photoreceptor potential after the one cycle rest (cycle 19) and compare to cycle 18 DDP voltage. The change in the response of the system is called "Delta" and is used in the calculation for corrections to the grid voltage after a short amount of rest time.

Cycle 20: Transfer spiking to clean back of cleaner blade. The transfer corotron is cycled on and off during the entire belt revolution. This is done in attempt to clean the back of the cleaner blade if toner has accumulated during the ESU. If toner is present on the back of the blade and a large fringe field is present from the lead edge of the last copy, it is possible to produce a defect known as 'line on copy' (LOC). Spiking of the transfer to the photoreceptor can pull toner into a non-image area and prevent printout of the LOC defect.

It should be understood that the scope of the present invention encompasses many alternative variations on sensing patches through a CSDC sensor and making scorotron grid adjustments. For example, another embodiment for cycle 7 is to use one patch within cycle 7 to predict other patch grid settings. By the time the patch 1 has been charged and has rotated on the photoreceptor belt to the developer station to be sensed by the CSDC, as seen in FIG. 1, patch 2 has already been laid down on the photoreceptor. Patch 1 has rotated to the developer station and provides a CSDC signal prior to the generation of patch 3. Therefore, the CSDC signal provided for patch 1 can be used to adjust the scorotron grid voltage for generating patch 3 to move the scorotron grid voltage toward the target level.

In a similar fashion, the CSDC signal read for patch 2 at the developer station can be used to adjust the scorotron grid voltage for the generation of patch 4, the CSDC reading for patch 3 used to adjust the grid voltage for the generation of patch 5, and the reading for patch 4 adjust the grid voltage for the generation of patch 6.

Thus, for whatever embodiment used, a grid voltage has been determined for each individual segment of the photoreceptor belt. However, certain segments or patches may be acceptable at this point or in range and certain may not be within range. In accordance with another embodiment, if a given number of patches are not within range, the machine could have various options such as setting a fault code for future use by a service representative or the machine could continue with a predicted grid voltage setting until the copy quality has deteriorated to a given level.

If, however, there are enough good photoreceptor segments, calculations or grid settings for each segment are made according to a predetermined procedure. In one embodiment, segment 1 is known to be the segment adjacent the fuser during at rest periods and a given decrease in grid voltage is made to compensate for that particular segment. The grid voltage for the other segments is the average setting of the acceptable segments. It should be understood that many alternatives are possible and that each segment could receive a discrete grid voltage based upon the CSDC patch readings.

In addition to the comprehensive electrostatic parameter adjustments during periodic photoreceptor analysis, in accordance with the present invention, there are additional parameter adjustments to further maintain copy quality. These adjustments include the rest recovery and loss of DDP discussed above peculiar to a specific photoreceptor. These adjustments are a function of photoreceptor behavior based upon factors such as cumulative photoreceptor cycles, the number of photoreceptor cycles for a particular job, and photoreceptor rest time between jobs. Primarily the scorotron grid voltage, but also the exposure lamp voltage and the developer bias voltage can be adjusted to compensate for short term photoreceptor electrical instability.

By describing the photoreceptor electrical behavior based upon various factors, adjustments can be made to compensate for photoreceptor rest recovery, photoreceptor cycle down or DDP loss and photoreceptor control error including drift. The various factors include total belt cycles, cycles per job, rest time of the photoreceptor between job runs, the magnitude of the grid voltage determined through the most recent electrostatic set up, cycle down such as from cycles 9 to 18 during a set up, and rest recovery such as measured between cycles 18 and 20. It should be noted that some of the parameter adjustments are based upon information or factors determined during the electrostatic set up and other adjustments are predetermined adjustments based upon the number of photoreceptor cycles during jobs and the rest time between jobs.

Figure 6:
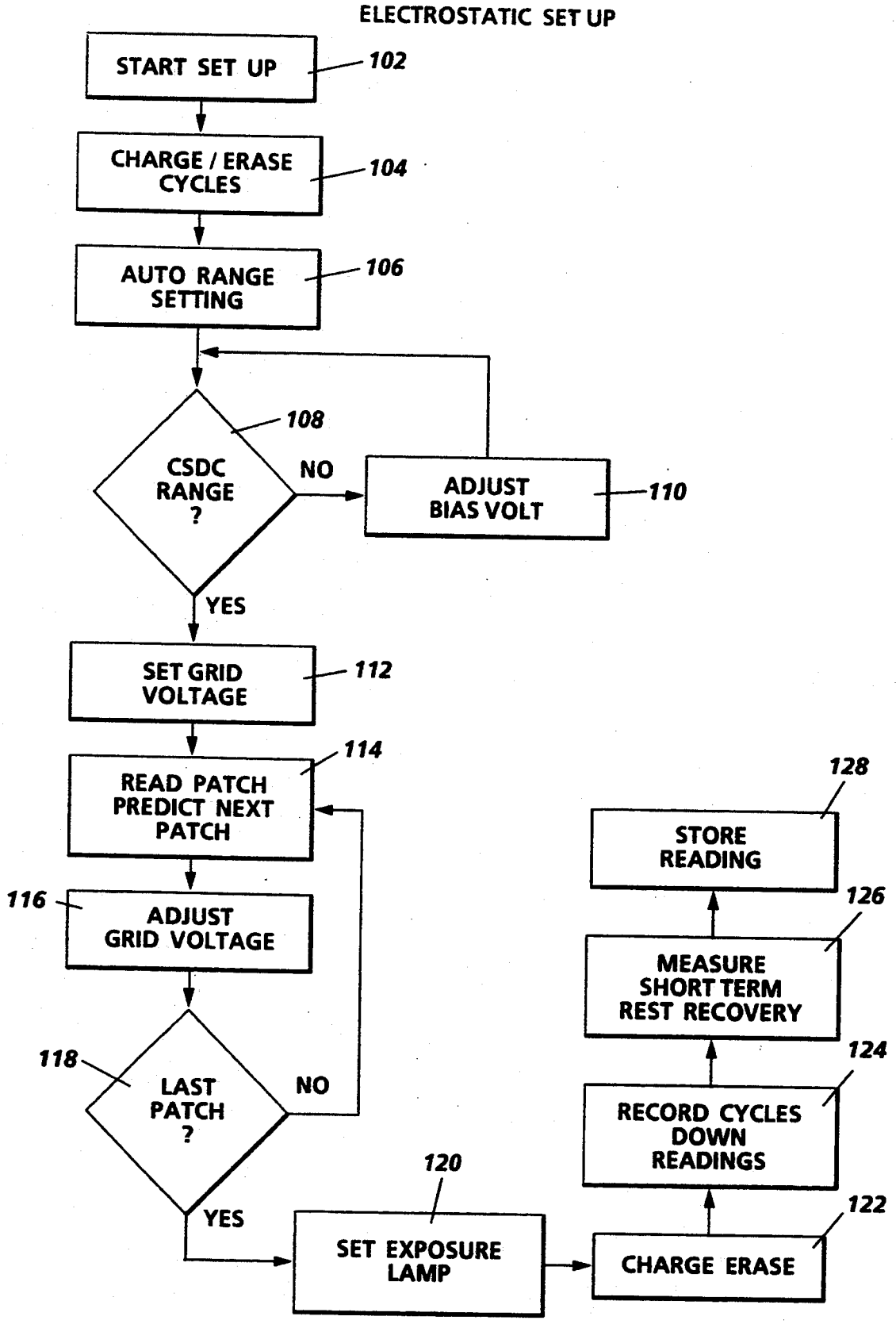
FIG. 6 is a flow chart illustrating an overall procedure for measuring and adjusting photoreceptor characteristics.
Figure 7:
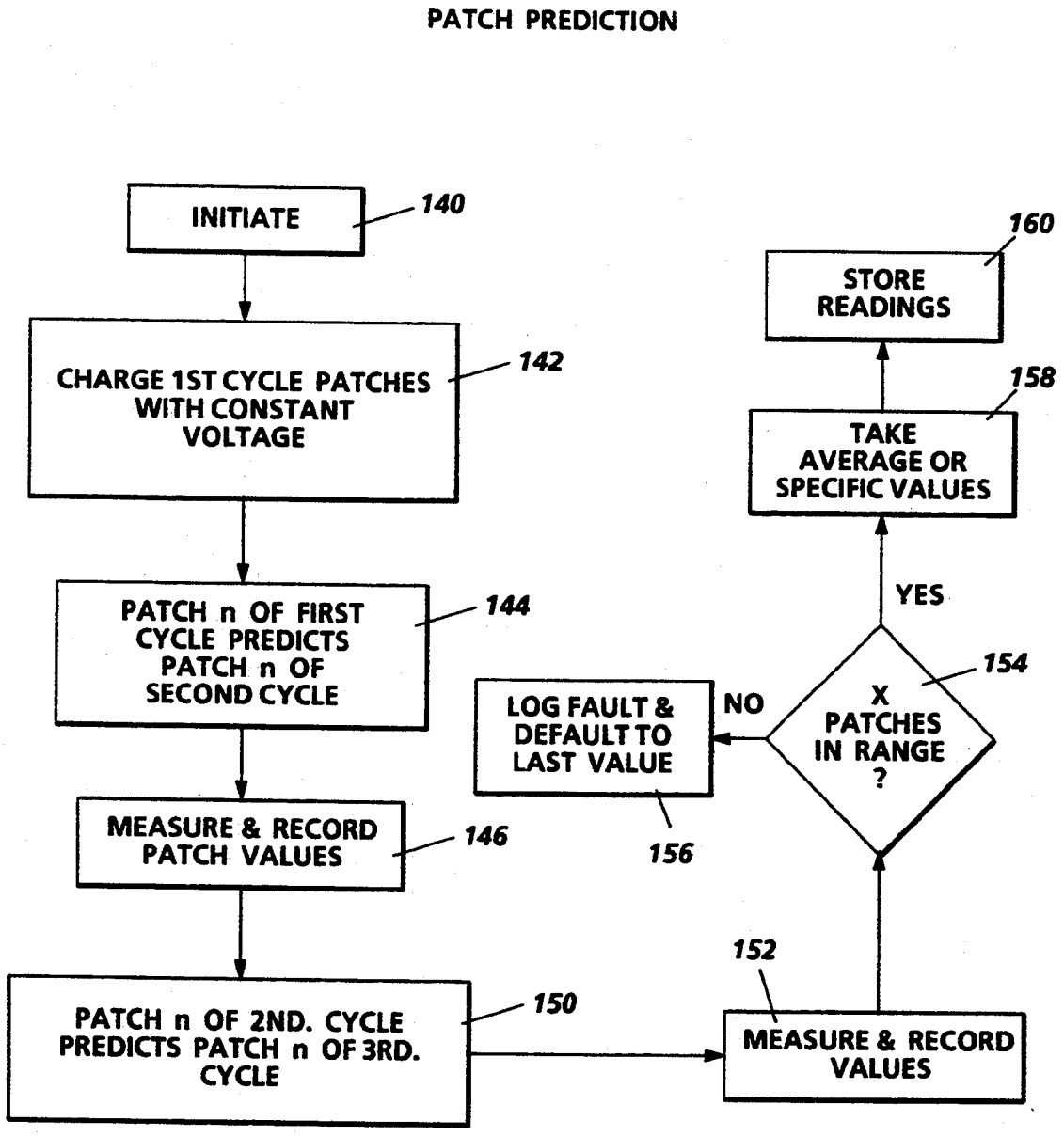
FIG. 7 is a flow chart illustrating a technique for the compensation of non-uniform or discrete segment electrostatic behavior of a photoreceptor.
Figure 8:
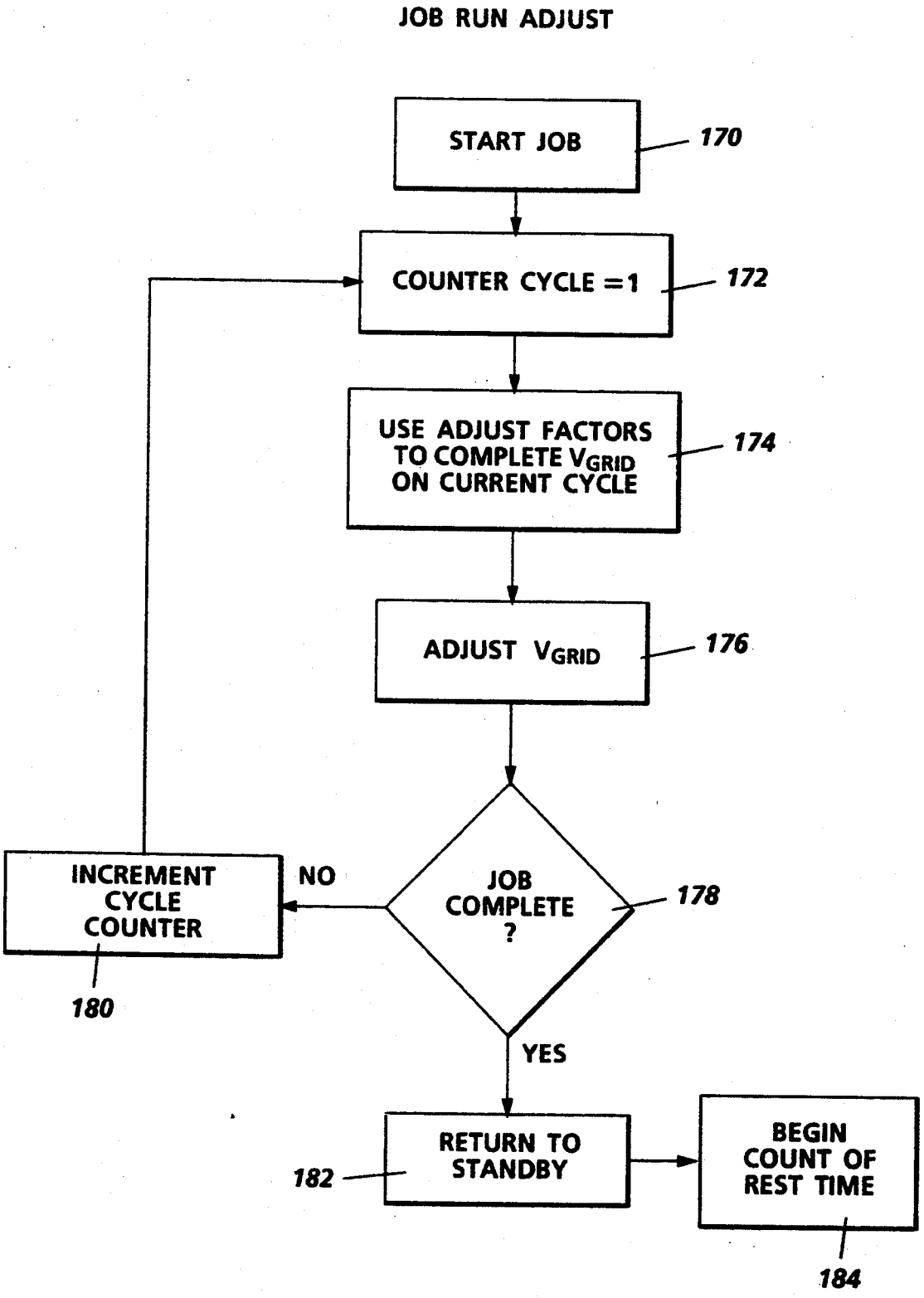
FIG. 8 is a flow chart illustrating a procedure for making job run related corrections to charging grid voltage.

With reference to the FIG. 6, 7, and 8 flow charts, the above described procedures are further explained. In FIG. 6, there is shown a general photoreceptor electrostatic set up using CSDC technology. After the initial start of the set up shown at block 102, there is a sequence of charge/erase cycles at 104 to condition the photoreceptor. The sequence of charge/erase cycles to condition the photoreceptor is followed by the auto range setting 106 of the grid voltage of the scorotron. This is a sequence of steps to jog the bias voltage on the developer housing until a CSDC signal is measured within a desired range ,as shown at 108 and 110. Auto range determines the starting grid voltage, block 112, to develop patches on the photoreceptor for determining the voltage on the photoreceptor and in turn for adjusting the scorotron grid voltage. Thus, blocks 114, 116, and 118 generally illustrate the reading of patches, predicting of grid voltages for subsequent patches, and adjusting grid voltages based upon patch readings.

After the set DDP procedure or after the last patch has been developed and measured for grid voltage adjust, the procedure uses the grid voltage setting to set the exposure lamp voltage as shown at block 120. It should be understood that the various patch readings to adjust the grid voltage include estimating grid voltage to be used for a given patch or patch prediction. One method of patch prediction is illustrated in more detail in FIG. 6. After the setting of the exposure lamp, there is another sequence of charge/erase cycles at block 122 with further readings for photoreceptor DDP cycle down and photoreceptor short term rest recovery at 124 and 126. These readings are stored, block 128, for the job run related adjustments as illustrated in FIG. 8.

With reference to FIG. 7, a typical patch prediction scenario is illustrated. As shown, after initiation at block 140, all patches for the first cycle are charged with a constant grid potential as illustrated at block 142. Next, patch n of a first revolution or cycle predicts patch n of the second revolution or cycle shown at 144 and measured values are stored at block 146. At block 150, patch n of a second revolution predicts patch n of the third revolution and measured values are stored at block 152. In all cases, the grid-adjustment or grid values are recorded. Next, there is a decisional step 154 in which according to a predetermined scenario, the values for each patch segment are determined to be or not to be within a given range. In particular, in the general case, if a given number of patches are not within a preferred range, a fault is logged and the system defaults to the last recorded values as shown at block 156. Otherwise, average values or specific values for specific segments can be stored as generally illustrated at 158. As discussed above, in one scenario, a specific value for a segment of the photoreceptor normally at rest near the fuser element is treated separately from the other patch segments. For the other segments, an average value is taken for the initial grip voltage setting. As the final step, as shown at block 160, these readings are stored in suitable memory for future use.

With reference to FIG. 8, there is a job run related adjustment made to grid voltage based upon various factors. After the start of a job shown at block 170, a cycle counter is set at one as illustrated at 172. The grid voltage is determined or computed in the current cycle as shown at 174 based upon the various factors such as total belt cycles, cycles per job, rest time of the photoreceptor between job runs, the magnitude of the grid voltage determined through the most recent electrostatic set up, cycle down such as from cycles 9 to 18 during a set up, and rest recovery such as measured between cycles 18 and 20. This information is stored and continually updated in predetermined counters and memory locations in the controller. The grid voltage is adjusted as shown at 176. The cycles of the photoreceptor for the current job are then counted until the job is completed as illustrated at blocks 178 and 180. After the job is complete, the system returns to standby, block 182, and a clock in memory begins to count the photoreceptor rest time, block 184, which will be factored in future adjustments.

It should be understood that the scope of the present invention is not limited to the specific embodiments described, but is intended to cover basic techniques of photoreceptor voltage adjustment. For example, one technique is the basic use of developer to photoreceptor current sensing for photoreceptor voltage adjustment.

Another technique is general electrostatic photoreceptor analysis and set up including such features as stepping the bias voltage on the developer to obtain a predetermined reading on a developer to photoreceptor current sensor, providing signals from the sensor in response to developing a series of test patches on the photoreceptor, adjusting a charging device in response to the signals, initiating a plurality of charge and erase photoreceptor cycles to measure cycle down change in photoreceptor voltage, and determining a short term photoreceptor rest recovery factor.

Another technique includes maintaining in memory a record of photoreceptor usage and combining with a record of voltage characteristics peculiar to a specific photoreceptor to adjust a corona device. For example, in addition to a memory for storing photoreceptor cycle down and rest recovery characteristics, a counter maintains a count of photoreceptor usage such as cumulative or present job photoreceptor cycles, and a clock determines the time period between the completion of a previous job and the initiation of a current job for adjusting the corona device charging grid.

These measurements can be used not only to make initial or periodic machine set ups, but can also be used to make further voltage adjustments during machine operation based upon photoreceptor characteristics. As illustrated in FIG. 1, suitable controls, memory, clocks, and logic circuitry implement a given embodiment. It should also be noted that these measurements can be generated automatically at predetermined intervals or upon sensing predetermined machine conditions or can be initiated manually at predetermined occurrences such as replacement of key machine elements. Suitable control routines can be triggered to selectively determine such factors as cycle down and rest recovery characteristics.

Another technique includes adjusting the photoreceptor voltage levels in relation to discrete photoreceptor segments. For example, a sensor provides signals in response to developing a series of test patches on the photoreceptor. The signals are a measure of current flow between the photoreceptor and the developer and circuitry relates the signals to a given test patch. Logic associates each of the test patches to a given segment of the photoreceptor and a corona control adjusts the corona device for charging the photoreceptor to preferred voltage levels for each of the discrete photoreceptor segments. Thus, data or records can be maintained for discrete photoreceptor segments to be used to adjust the voltage for a discrete segment independent of other segments. Also, the signal for a given test patch can be used to set the charging grid for developing a subsequent patch. That is, the signals or grid voltages for corona charging for a given patch can be used to predict the grid voltages or charging potential for a subsequent developed patch.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

We claim:

1. In an image processing apparatus having a corona device with a grid for charging a photoreceptor to given voltage levels, an exposure device for projecting an image of an object along an optical path onto the photoreceptor, and a developer for applying charged toner to the photoreceptor, a method for adjusting the corona device for charging the photoreceptor comprising the steps of:

forming a predetermined test patch on the photoreceptor, moving the test patch to the developer and transferring toner from the developer to the test patch at the developer, sensing the movement of charged toner from the developer to the photoreceptor, responsive to the movement of charged toner from the developer to the photoreceptor providing a signal, and responsive to the signal, adjusting voltage on the grid of the corona device to vary the voltage level on the photoreceptor.

2. The method of claim 1 wherein the movement of charged toner from the developer to the photoreceptor is a measure of current flow between the developer and the photoreceptor.

3. The method of claim 1 wherein the movement of charged toner from the developer to the photoreceptor is a measure of voltage on the photoreceptor.

4. A method of controlling voltage on a photoconductive surface comprising the steps of:

forming a predetermined test patch on the photoconductive surface, transferring charged toner from a developer to the test patch, sensing the movement of the charged toner from the developer to the photoconductive surface and providing a signal, and responsive to the signal determining the voltage on the photoconductive surface.

5. The method of claim 4 wherein the signal is a measure of current flow between the developer and the photoconductive surface.

6. The method of claim 4 including a charging grid for charging the photoconductive surface and including the step of adjusting voltage on the grid in response to said signal to vary voltage levels on the photoconductive surface.

7. An image processing apparatus having a corona device for charging a photoreceptor to a first voltage level, an exposure device for projecting an image of an object along an optical path onto the photoreceptor, a developer for applying toner to the photoreceptor, a sensor for providing a signal in relation to current flow between the photoreceptor and the developer as a result of the developer applying toner to the photoreceptor, and a corona control responsive to said signal for adjusting the corona device for charging the photoreceptor to a second voltage level.

8. The processing apparatus of claim 7 wherein the sensor measures current flow in the range of 0–10 microamps.

9. The processing apparatus of claim 7 wherein the sensor includes an amplifier for converting current range into voltage in the range of 0–10 volts.

10. The processing apparatus of claim 7 including an exposure control responsive to said signal for adjusting the exposure device.

11. The processing apparatus of claim 7 wherein the corona device includes a grid and said corona control responds to said signal for adjusting the grid for charging the photoreceptor.

12. The processing apparatus of claim 7 wherein the signal is a measure of voltage levels on the photoreceptor.

13. Apparatus for controlling voltage on a photoconductive surface comprising:

a charging device for electrostatically forming a predetermined test patch on the photoconductive surface, a developer for transferring charged toner to the test patch, a sensor for measuring the movement of the charged toner from the developer to the photoconductive surface and providing a signal, and a control responsive to the signal for determining the voltage on the photoconductive surface.

14. The apparatus of claim 13 wherein the charging device includes a charging grid and the control adjusts voltage on the grid in response to said signal to vary voltage levels on the photoconductive surface.

* * * * *